United States Patent [19]

Oye

[11] Patent Number: 4,559,853

[45] Date of Patent: Dec. 24, 1985

[54] FISH LOWER LIP GRIPPER TOOL

[76] Inventor: Tom Oye, 2913 Carnaby La., Garland, Tex. 75042

[21] Appl. No.: 633,580

[22] Filed: Jul. 23, 1984

[51] Int. Cl.[4] ..... B25B 7/02

[52] U.S. Cl. ..... 81/420; 81/426

[58] Field of Search ..... 81/418, 420, 425 R, 81/425 A, 426, 424.5, 426.5; 29/268; 43/53.5

[56] References Cited

U.S. PATENT DOCUMENTS

| | | | |
|---|---|---|---|
| 902,570 | 11/1908 | Ellis | 81/426 |
| 2,274,126 | 2/1942 | Carrigan | 29/268 |
| 4,017,958 | 4/1977 | Diggs | 29/268 |
| 4,461,193 | 7/1984 | Gruber et al. | 81/420 |

*Primary Examiner*—James L. Jones, Jr.
*Attorney, Agent, or Firm*—Warren H. Kintzinger

[57] ABSTRACT

A pliers like tool having a transversely extended lower anvil portion replacing a person's index finger and a smaller hammer portion taking the place of a person's thumb in gripping the lower lip of a fish in place of the index finger below the lower lip and the thumb of the same hand sticking into the fish's mouth holding the fish in a relaxed state with its mouth open. This facilitates removal of the fish hook safely from the fish without injury to the person and minimal injury to the fish. The anvil portion and the smaller hammer portion of the tool gripping head are vinyl covered to further avoid injury to fish held by the lower lip gripping tool.

8 Claims, 8 Drawing Figures

FISH LOWER LIP GRIPPER TOOL

Figure 1:
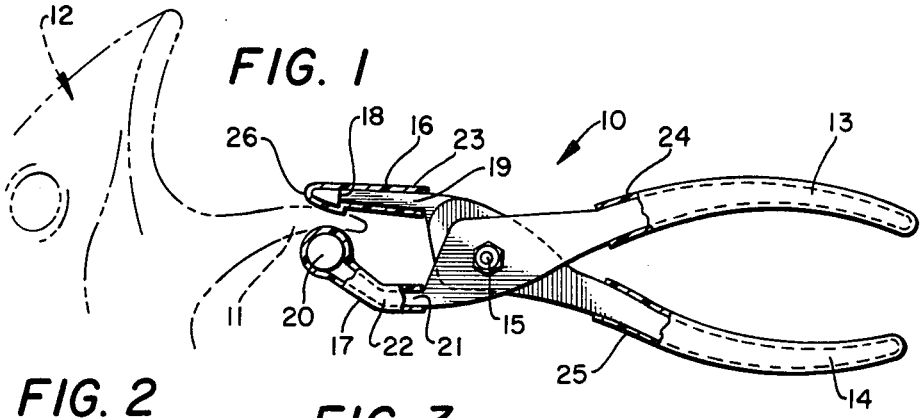

This invention relates in general to fish holding and restraining methods and devices, and more particularly, to a fish lower lip gripping tool.

Removing fish hooks from the mouths of fish has been a problem for many people. Some people step on a fish and yank the hook out of its mouth. Other people grab squirming wiggling fish to get cut by its gills or stuck by its fins. These approaches not only present problems for the fisherman including injury to many but also injury to the fish you wish to throw back. Professional fishermen have always known that the safest way to handle a caught fish is to hold it by its lower lip with the fish thereupon relaxing with its mouth opening. This with many fish allows one to remove the hook safely without injury to one's self and minimal if any injury to the fish. This has been accomplished by many fisherman with the thumb and index finger of one hand, however, some fish cannot be gripped in this manner since they are too small, too large or have sharp teeth. A tool than can replace the thumb and index finger that is easily reuseable is ideal for use on such difficult to handle fish and even those not difficult to handle. Many people just do not take to sticking thumbs into the mouth of a fish. Such a tool would be ideal for the young fisherman who too often gets hurt due to lack of strength and coordination and also because one is less likely to get his hands slimey and wipe them on clothing creating a general mess.

It is therefore a principal object of this invention to eliminate the hazards of fish handling when removing a fish hook from a caught fish's mouth.

Another object is to provide a gripping tool for gripping the lower lip of caught fish in place of using the thumb and index finger of a person's hand.

A further object is to minimize injury to fish while removing a hook from their mouth particularly with respect to those fish you want to throw back.

Features of the invention useful in accomplishing the above object include, in a fish lower lip gripping tool, a pliers like tool having a transversely extended lower anvil portion replacing a person's index finger and a smaller hammer jaw like portion taking the place of a person's thumb in gripping the lower lip of a fish. Pliers like handles are gripped by the hand pivoting the jaws in the form of the lower anvil and the upper hammer about a pivot in gripping the lower lip or jaw of a fish. Vinyl coatings, or coverings, on the tool jaw and hammer portions help minimize or avoid injury to a fish so held.

Specific embodiments representing what are presently regarded as the best modes of carrying out the invention are illustrated in the accompanying drawing.

Figure 2:
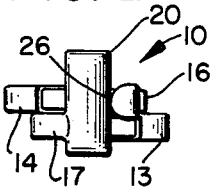
Figure 3:
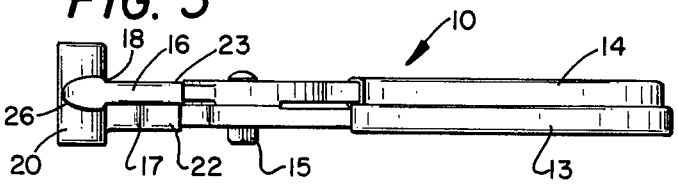
Figure 4:
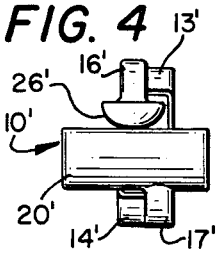
Figure 5:
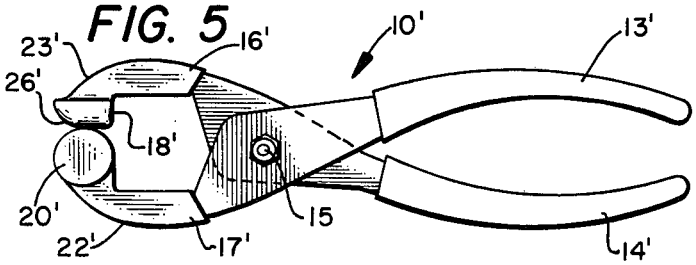
Figure 6:
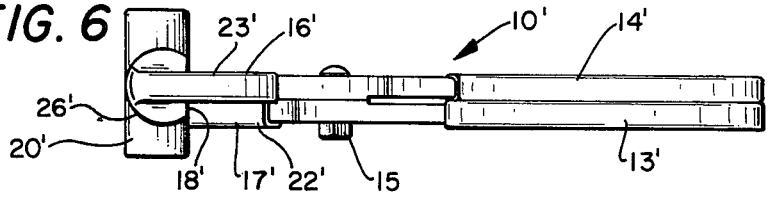
Figure 7:
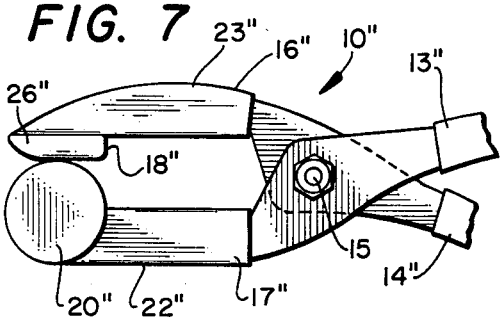
Figure 8:
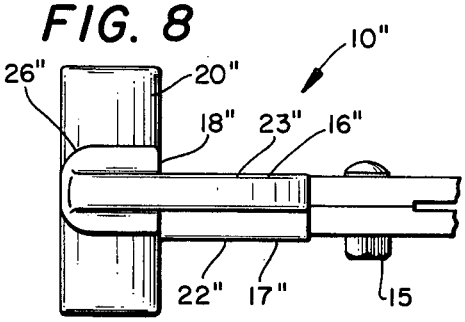

In the drawing:

FIG. 1 represents a side elevation view of a pliers like fish lower lip gripper for holding fish, safely and cleanly while removing the fishing hook, putting on a stringer or releasing the fish;

FIG. 2, a jaw end view of the fish lower lip gripper tool of FIG. 1;

FIG. 3, a top plan view of the fish lower lip gripper tool of FIGS. 1 and 2 that is a pan fish size embodiment of the tool;

FIG. 4, a jaw end view of a bass size fish lower lip gripper tool;

FIG. 5, a side elevation view of the fish lower lip gripper tool of FIG. 4;

FIG. 6, a top plan view of the fish lower lip gripper tool of FIGS. 4 and 5;

FIG. 7, a partial side elevation view of a wall mount trophy size of a fish lower lip gripper tool; and FIG. 8, a partial top plan view of the fish lower lip gripper tool of FIG. 7.

Referring to the drawing:

A fish lower lip gripper tool 10 is shown in FIG. 1 to be gripping the lower lip 11 of a fish 12 in safely and cleanly holding the fish while removing the fishing hook and putting on a stringer or releasing the fish 12. While many fisherman have used pliers of various types, long nose and others, in place of the thumb and index finger of a hand this has not proven too satisfactory with excessive injury to fish that are to be released or kept as trophy fish. The jaws of a pliers can impose excessive unit area pressures on the flesh, bone and/or cartilage structure, and teeth, and have sharp jaw edges that cause severe injuries to the lower lip of the fish so held. These problems are in large measure eliminated in the pliers like tool 10 wherein handles 13 and 14 are pivoted around pivot pin structure 15 to close and open upper hammer jaw element 16 relative to anvil jaw element 17 in gripping and releasing the lower lip 11 of a fish 12. As can be seen referring also to FIGS. 2 and 3 the anvil jaw element 17 is a transversely extended lower anvil jaw element 17 that presents more support area like a cocked index finger than an ordinary pliers jaw under the bottom lip 11 of a fish 12. The upper hammer jaw element 16 is much smaller than the anvil jaw element 17 and is extended downward with shoulder 18 in order that the shank 19 of upper hammer jaw element 16, like a slightly cocked thumb, can clear teeth of fish having teeth on its lower lip 11 and also to aid in preventing the tool 10 slipping out of the fish's mouth while gripping the lower lip 11. The transversely extended lower anvil jaw element 17 is like a round bar length 20 mounted on the shank 21 of the lower anvil jaw element 17 in eccentric offset relation to shank 21 in order to be transversely centered with respect to upper hammer jaw element 16. The lower anvil jaw element 17 is covered with a boot like vinyl covering 22 and the upper hammer jaw element 16 is covered with a boot like vinyl covering 23 conformed to the shape thereof as a further aid in avoiding injury to fish held by the fish lower lip gripping tool. The pliers like handles 13 and 14 are provided with vinyl grip coats 24 and 25 for better tool 10 grip and ease of handling. The hammer pad 26 of the upper hammer jaw element 16 is generally rounded on the bottom.

With the bass size fish lower lip gripper tool 10' of FIGS. 4, 5 and 6 the hammer pad 26' is larger than with the embodiment of FIGS. 1, 2 and 3 and extends down further than the pad 26 with a larger shoulder 18'. With this embodiment elements the same other than being larger are numbered the same as with the embodiment of FIGS. 1, 2 and 3 and those elements similar but modified some are given primed numbers as a matter of convenience and without repeating all the description again and with it being substantially the same. The lower jaw, i.e. lower anvil jaw element 17' in this instance is a larger more angular element with a larger round bar length 20'.

With respect to the embodiment of FIGS. 7 and 8 a fish lower lip gripper tool 10'' is presented that is even larger and suitable for wall mount trophy size fish. Here elements are given double primed identification numbers and description is not repeated again as a matter of convenience.

Whereas this invention has been described with respect to several embodiments thereof, it should be realized that various changes may be made without departure from the essential contributions to the art made by the teachings hereof.

I claim:

1. A fish lower lip gripper tool comprising: a pliers like tool having an upper jaw and a lower jaw connected to handles pivoted around a common pivot pin interconnection for operation of said upper jaw and said lower jaw toward each other in a gripping action and away from each other in a release movement in pliers like action; said upper jaw having a downward facing rounded gripping face; and said lower jaw having a transversely extended curved anvil and support surface transversely extended relative opening and closing movement of said upper and lower jaws; wherein said transversely extended curved anvil and support surface is transversely extended materially beyond the width of the downward facing rounded gripping face of said upper jaw; and wherein said transversely extended curved anvil and support surface is in the form of a length of round bar mounted on a lower jaw element shank.

2. The fish lower lip gripper tool of claim 1, wherein said transversely extended curved anvil and support surface is approximately twice as long as the width of the downward facing rounded gripping face of said upper jaw.

3. The fish lower lip gripper tool of claim 1, wherein said transversely extended curved anvil and support surface is transversely centered relative to the rounded gripping face of said upper jaw.

4. The fish lower lip gripper tool of claim 3, wherein said transversely extended curved anvil and support surface is mounted in offset eccentric relation on said lower jaw element shank in order to be transversely centered relative to the rounded gripping face of said upper jaw.

5. The fish lower lip gripper tool of claim 4, wherein said upper jaw includes an upper jaw element shank mounting said downward facing rounded gripping face as part of a gripping hammer head extending below the level of said upper jaw element shank.

6. The fish lower lip gripper tool of claim 5, wherein downward extension of said downward facing rounded gripping face is in the form of a rear shoulder on said gripping hammer head extending below the level of said upper jaw element shank.

7. The fish lower lip gripper tool of claim 6, wherein both said upper and lower jaws are coated with plastic.

8. The fish lower lip gripper tool of claim 7, wherein the two handles of the tool are provided with plastic grip coverings.

* * * * *